US010182669B1

(12) United States Patent
Kula

(10) Patent No.: US 10,182,669 B1
(45) Date of Patent: Jan. 22, 2019

(54) MECHANISM FOR SECURING A TRAY AND THE LIKE

(71) Applicant: INTERNATIONAL PAPER COMPANY, Memphis, TN (US)

(72) Inventor: Gregory James Kula, Aurora, IL (US)

(73) Assignee: INTERNATIONAL PAPER COMPANY, Memphis, TN (US)

( * ) Notice: Subject to any disclaimer, the term of this patent is extended or adjusted under 35 U.S.C. 154(b) by 0 days.

(21) Appl. No.: 16/005,914

(22) Filed: Jun. 12, 2018

Related U.S. Application Data

(62) Division of application No. 15/654,258, filed on Jul. 19, 2017, now Pat. No. 10,016,075.

(51) Int. Cl.

| | |
|---|---|
| ***A47F 5/10*** | (2006.01) |
| ***A47B 57/40*** | (2006.01) |
| ***A47F 5/00*** | (2006.01) |
| *A47B 57/16* | (2006.01) |
| *A47B 57/06* | (2006.01) |
| *A47B 43/00* | (2006.01) |

(52) U.S. Cl.
CPC ..... *A47F 5/101* (2013.01); *A47B 57/404* (2013.01); *A47F 5/0062* (2013.01); *A47B 43/00* (2013.01); *A47B 57/06* (2013.01); *A47B 57/16* (2013.01)

(58) Field of Classification Search
CPC ..... A47F 5/101; A47F 5/0062; A47B 57/404; A47B 57/16; A47B 57/06; A47B 43/00
USPC ..... 211/72, 149, 73, 135, 195, 186, 187, 211/132.1, 99.01, 133.3, 134, 71.01, 85, 211/85.29, 90.01, 90.02, 90.04, 113, 118, 211/119.003, 126.1, 126.4, 126.16; 108/106–108, 110; 248/174
See application file for complete search history.

(56) References Cited

U.S. PATENT DOCUMENTS

| | | | |
|---|---|---|---|
| 1,273,397 | A | 7/1918 | Neill |
| 1,303,850 | A | 5/1919 | Bullock |
| 1,554,137 | A | 9/1925 | Slifkin |
| 1,802,245 | A | 4/1931 | Foretich |
| 1,972,406 | A | 9/1934 | Marsh |
| 1,976,810 | A | 10/1934 | Skar |
| 2,579,704 | A | 12/1951 | Saul, Jr. |
| 2,634,705 | A | 4/1953 | Mayes |
| 2,692,055 | A | 10/1954 | Feiertag |
| 2,918,178 | A | 12/1959 | Leone |
| 2,932,368 | A | 4/1960 | Schell, Jr. |
| 3,012,704 | A | 12/1961 | Stumpf, Jr. |

(Continued)

FOREIGN PATENT DOCUMENTS

| | | | |
|---|---|---|---|
| DE | 102010052074 | A1 | 5/2011 |
| EP | 2353435 | A1 | 8/2011 |

*Primary Examiner* — Jonathan Liu
*Assistant Examiner* — Devin K Barnett
(74) *Attorney, Agent, or Firm* — Thomas W. Ryan; Michael D. Folkerts

(57) ABSTRACT

A floor display system comprising a base portion including a front wall having opposing first and second vertical edges, and first and second side walls extending from the vertical edges in generally perpendicular relation to the front wall. At least one side wall slot is formed in each of the first and second side walls and connected to respective front wall slot portions formed in the front wall. At least one tray is provided including a tray body connected to at least one mounting flap portion positioned in each of the side wall slots in the first and second side walls and extending into the corresponding front wall slot portions for supporting the tray body to the base portion.

5 Claims, 7 Drawing Sheets

(56) References Cited

U.S. PATENT DOCUMENTS

| | | | |
|---|---|---|---|
| 3,292,796 | A | 12/1966 | Paige |
| 3,347,187 | A | 10/1967 | Khoury |
| 3,550,785 | A | 12/1970 | Siez |
| 3,794,183 | A | 2/1974 | Colbridge |
| 3,797,903 | A | 3/1974 | Traulsen |
| 3,836,104 | A | 9/1974 | Miller et al. |
| 3,983,823 | A | 10/1976 | McDonnell |
| 4,051,789 | A | 10/1977 | Howitt |
| 4,086,858 | A | 5/1978 | Howitt |
| D254,821 | S | 4/1980 | Rabas |
| 4,322,005 | A | 3/1982 | Robertson |
| 4,425,049 | A | 1/1984 | Travis |
| 4,444,323 | A | 4/1984 | Travis |
| 4,506,790 | A | 3/1985 | Muscari |
| 4,537,316 | A | 8/1985 | Simon et al. |
| 4,570,805 | A | 2/1986 | Smith |
| 4,577,092 | A | 3/1986 | Lenoir |
| 4,756,430 | A | 7/1988 | Spamer et al. |
| 4,805,863 | A | 2/1989 | Armstrong et al. |
| 5,129,525 | A | 7/1992 | Maynard, Jr. |
| 5,154,388 | A | 10/1992 | Magaro |
| D363,840 | S | 11/1995 | Weshler |
| 5,669,683 | A | 9/1997 | Moss et al. |
| 5,797,502 | A | 8/1998 | Brady et al. |
| 6,098,820 | A | 8/2000 | Smith |
| 6,119,875 | A | 9/2000 | Smith |
| D493,309 | S | 7/2004 | Moss et al. |
| 6,929,133 | B1 | 8/2005 | Knapp, III et al. |
| 6,953,896 | B2 | 10/2005 | Kleeberger et al. |
| 7,252,200 | B1 | 8/2007 | Hester |
| 7,497,344 | B2 | 3/2009 | Chen |
| 7,762,410 | B2 | 7/2010 | Colin et al. |
| 7,967,154 | B1 | 6/2011 | Sharon |
| 8,052,103 | B2 | 11/2011 | Ferraro et al. |
| 8,141,713 | B2 | 3/2012 | Farkas et al. |
| 8,167,253 | B2 | 5/2012 | Smith |
| 8,485,370 | B2 | 7/2013 | Dewhurst |
| 8,540,084 | B2 | 9/2013 | Waksul |
| 8,584,601 | B1 | 11/2013 | Deschner |
| 8,608,264 | B2 | 12/2013 | Wing |
| 8,695,816 | B2 | 4/2014 | Troyner et al. |
| D707,209 | S | 6/2014 | Ranaletta |
| 8,875,910 | B2 | 11/2014 | Wurr et al. |
| 9,173,506 | B2 | 11/2015 | Andersson et al. |
| 9,781,998 | B2 | 10/2017 | Mogensen et al. |
| 2002/0148849 | A1 | 10/2002 | Robert et al. |
| 2002/0175133 | A1 | 11/2002 | Hiltke et al. |
| 2003/0160015 | A1 | 8/2003 | Broerman |
| 2003/0205545 | A1 | 11/2003 | Moceri |
| 2004/0222178 | A1 | 11/2004 | Sparkowski |
| 2005/0092705 | A1 | 5/2005 | Moss et al. |
| 2005/0127017 | A1 | 6/2005 | Kessel et al. |
| 2005/0199568 | A1 | 9/2005 | Gay et al. |
| 2007/0045210 | A1 | 3/2007 | Richardson |
| 2007/0235396 | A1 | 10/2007 | Moss et al. |
| 2008/0067301 | A1 | 3/2008 | Moss et al. |
| 2008/0083682 | A1 | 4/2008 | Moss et al. |
| 2011/0266239 | A1 | 11/2011 | Daily |
| 2014/0083959 | A1 | 3/2014 | Kalafut |
| 2014/0217047 | A1 | 8/2014 | Frost |
| 2015/0201762 | A1 | 7/2015 | Walter |
| 2017/0265655 | A1 | 9/2017 | Kinzelman et al. |

MECHANISM FOR SECURING A TRAY AND THE LIKE

FIELD OF THE INVENTION

This invention relates generally to a display system and, more particularly, to a floor display system including a base and attachable shelf or tray members that are secured to the base for displaying products.

BACKGROUND OF THE INVENTION

It is common practice to load a quantity of individual packages of consumer products into corrugated paperboard shipping containers for bulk shipment of the packages to a point of sale. In some applications, the packages may be shipped with a collapsible display rack that is configured to be erected at the point of sale to form a self-supporting display rack. For example, the display rack may be configured for customer packaged goods (CPG)/retail customers and can comprise a collapsible base and separate tray units formed of corrugated paperboard that can be shipped disassembled in a compact package to a point of sale. The self-supporting display rack may be easily and quickly assembled at the point of sale without requiring tools. In a particular application, a supplier can pre-load tray units with product and place the tray units in a shipping container along with a collapsed base for shipping to a customer, and it is conventional for the customer to erect the base and attach the tray units to the erected base using mounting hooks or clips to complete the display at the point of sale.

SUMMARY OF THE INVENTION

In accordance with an aspect of the invention, a floor display system is provided comprising a base portion including a front wall having opposing first and second vertical edges, and first and second side walls extending from the vertical edges in generally perpendicular relation to the front wall. At least one side wall slot is formed in each of the first and second side walls and connected to respective front wall slot portions formed in the front wall. At least one tray is provided including a tray body connected to at least one mounting flap portion positioned in each of the side wall slots in the first and second side walls and extending into the corresponding front wall slot portions for supporting the tray body to the base portion.

The side wall slots may angle downward from the corresponding front wall slot portions.

Each of the side wall slots may be defined by first and second slot edges connected at a slot apex distal from the front wall and diverging from each other extending from the slot apex toward the front wall.

A detent edge may extend from one of the first and second slot edges toward the other of the first and second slot edges and may define a reduced width of the side wall slot adjacent to the front wall.

The at least one mounting flap portion may include first and second flap sections joined at a flap fold positioned adjacent to the slot apex.

The first flap section may be hingedly connected to the tray body and the second flap section may include a locking edge distal from the flap fold and engaged against the detent edge to resist movement of the mounting flap portion out of the side wall slot.

The detent edge may extend generally perpendicular to said one of the first and second slot edges.

The front wall slot portions may be defined by a continuous slot extending across the width of the front wall, and the at least one mounting flap portion may define a width greater than the width of the front wall.

The front wall slot portions may be defined by discrete slots extending horizontally across a portion of the front wall adjacent to the vertical edges, and the at least one mounting flap portion may comprise separate first and second flap members engaged in the first and second side wall slots.

In accordance with another aspect of the invention, a display system is provided including a connector for connecting first and second corrugated paperboard members. The first corrugated paperboard member comprises a first wall and a second wall extending transverse to the first wall at a fold line; a slot structure comprising a first slot portion in the first wall and a second slot portion in the second wall and extending contiguous with the first slot portion; the second slot portion including an entry section defined by first opposing edges and a latching section defined by second opposing edges diverging outwardly from a slot apex to a dimension greater than a dimension defined between the first opposing edges. The second corrugated paperboard member comprises a mounting flap portion including a first flap section and a second flap section joined to and resiliently biased from the first flap section at a flap fold; and wherein the second flap section extends within the latching section of the second slot portion and includes a locking edge located adjacent to the entry section of the second slot portion.

A detent edge of the slot structure may extend transverse to and connect an edge of the entry section and an adjacent edge of the latching section, and the locking edge of the second flap section may engage the detent edge adjacent to an intersection of the detent edge and the adjacent edge.

The first flap section may extend from the first slot portion to the slot apex within the second slot portion.

The first slot portion may extend on the first wall generally perpendicular to the fold line connecting the first and second walls, and at least one of the first opposing edges of the second slot portion may extend at an acute angle to the fold line.

Each of the opposing edges of the latching section and the entry section may extend at an acute angle to the fold line.

In accordance with a further aspect of the invention, a method of forming a floor display system is provided comprising: providing a base portion including a front wall having opposing first and second vertical edges, and first and second side walls connected to the front wall at vertical fold lines defined at the first and second vertical edges; providing front wall slot portions in the front wall and side wall slots in side walls contiguous with the front wall slot portions at the vertical edges; pivoting the first and second side walls about the vertical fold lines to positions generally perpendicular to the front wall to form a vertical column; providing a tray having a tray body hingedly connected to at least one mounting flap portion having first and second flap sections joined at a flap fold, and folding the second flap section into overlapping relation over the first flap section; inserting the at least one mounting flap portion, flap fold first, through the front wall slot portions into the side wall slots to support the tray body to the base portion.

The tray may be formed of corrugated paperboard and the second flap section may be resiliently biased from the first flap section at the flap fold by the corrugated paperboard to engage opposing edges defining each of the side wall slots as the at least one mounting flap portion is inserted into the side wall slots.

The side wall slots may each include an entry section adjacent to the front wall and a latching section located inwardly from the entry section, and insertion of the at least one mounting flap portion may include positioning the second flap section within the latching section.

The latching section may be defined by opposing slot edges that diverge extending from a slot apex toward the entry section and a detent edge extending transverse to and connecting an edge of the entry section and an adjacent edge of the latching section, and inserting the at least one mounting flap portion may include the second flap section moving away from the first flap section as a locking edge of the second flap section, distal from the flap fold, moves into the latching section to engage the detent edge.

Inserting the at least one mounting flap portion may include inserting the first and second flap sections through the entry section at an acute angle relative to the vertical fold lines.

The base portion may further include a back wall attached to the first and second side walls at vertical fold lines, wherein pivoting the first and second side walls about the front and back walls may form the base portion as a rectangular tube.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

The present description is directed to a floor display system of the type that may be used to display a product at a point of sale, such as for providing consumer packaged goods (CPG) to a retailer. The floor display system can be formed entirely of corrugated paperboard and may include a base portion and a plurality of trays supported on the base portion without additional hanging elements such as hooks or clips connecting the trays to the base portion.

Figure 1:
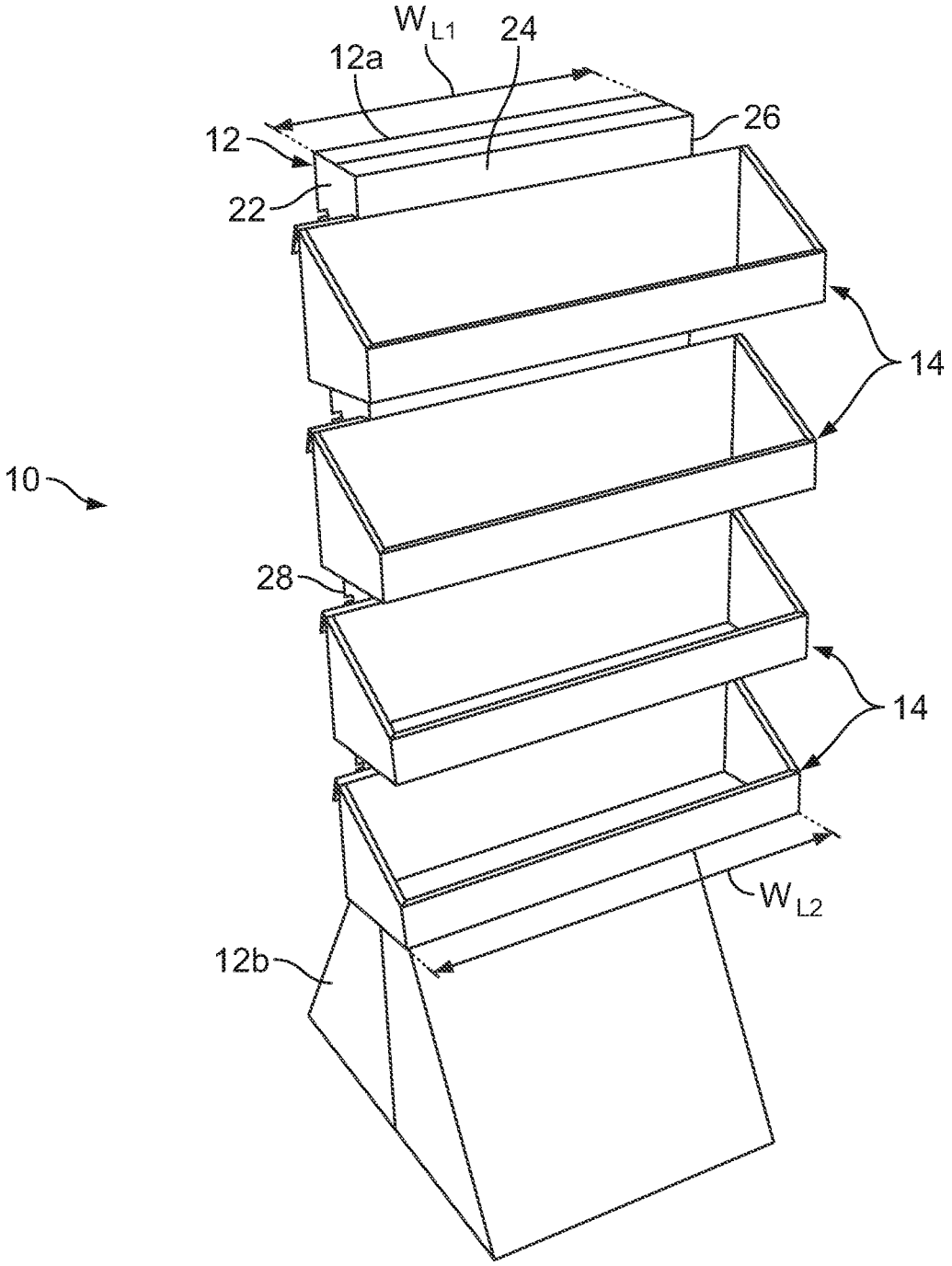
FIG. 1 is a front perspective view illustrating a floor display system in accordance with aspects of the invention.
Figure 2:
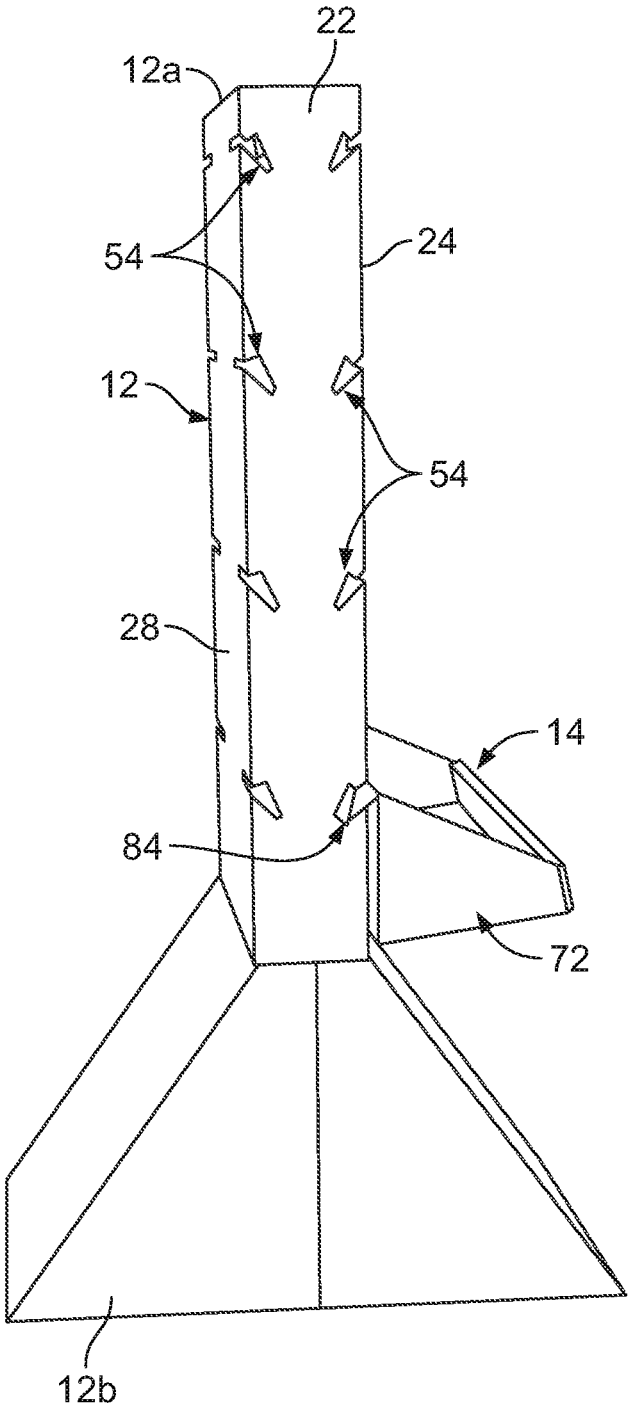
FIG. 2 is a rear perspective view illustrating a connector between a tray and a base portion of the floor display system.

Referring to FIGS. 1 and 2, a floor display system 10 is illustrated including a base portion 12 and a plurality of product trays 14 supported to the base portion 12. The base portion 12 can include a central tube 12*a* and a floor engaging base member 12*b*. The central tube 12*a* and base member 12*b* can be formed as separate components that are assembled together at a point of sale to support the central tube 12*a* in a vertical orientation. Although a particular configuration of the base portion 12 is described herein for illustrating aspects of the invention including a connection between the trays 14 and the base portion 12, it should be understood that the invention is not limited to the base portion shown herein and that alternative configurations of the base portion 12 may be provided.

Figure 3:
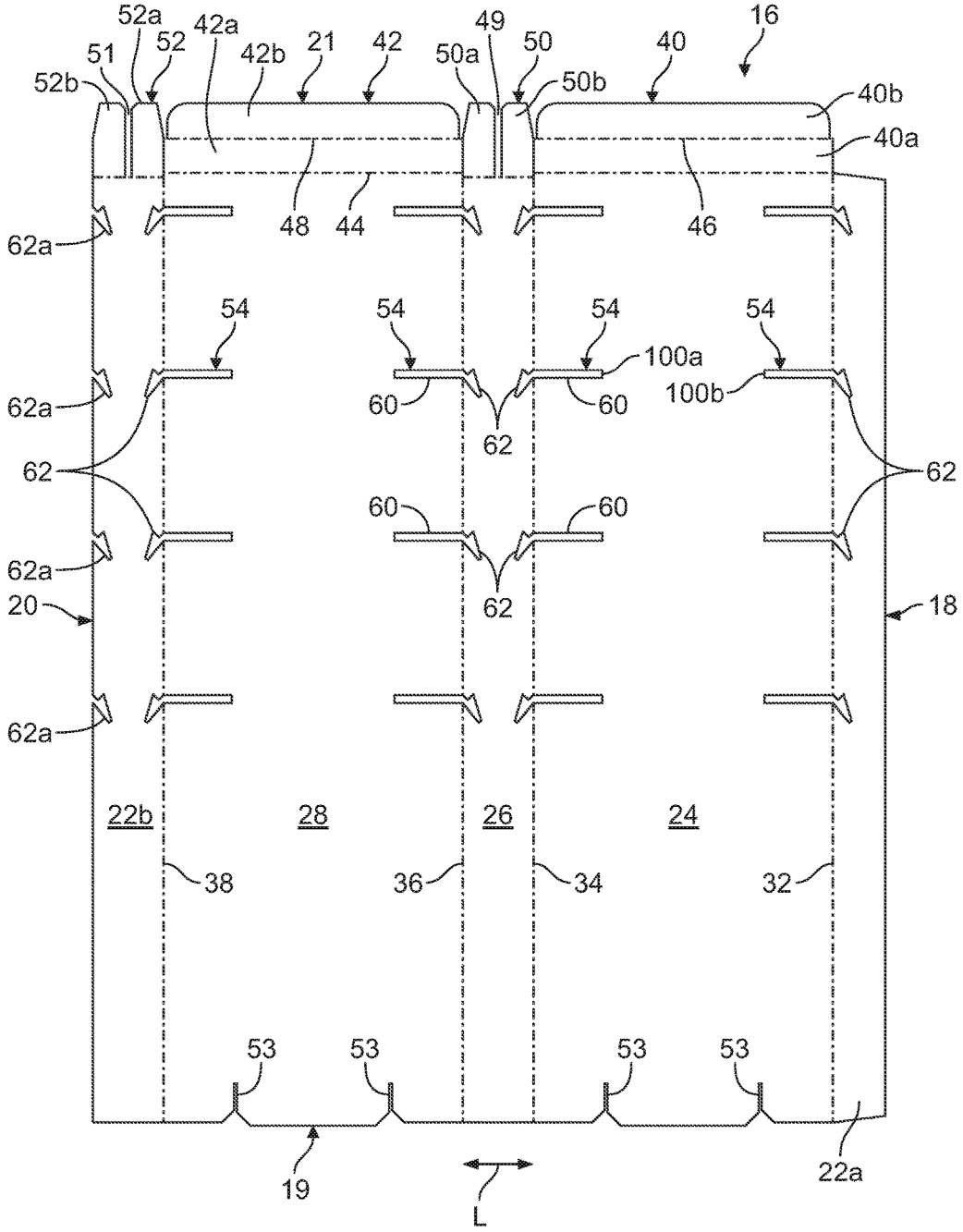
FIG. 3 is a plan view of a tube blank for forming a central tube of the floor display system.

Referring to FIG. 3 an exemplary tube blank 16 for forming the central tube 12*a* is illustrated and can comprise a corrugated paperboard member. The tube blank 16 extends in a lateral direction L between first and second lateral ends, generally designated 18 and 20, respectively, and further extends in a longitudinal direction, perpendicular to the lateral direction L, between first and second longitudinal ends 19, 21. The tube blank 16 comprises a first side wall glue tab 22*a*, a front wall 24, a second side wall 26, a rear wall 28 and a first side wall panel 22*b* connected in series. The glue tab 22*a* is connected to the front wall 24 at a first vertical fold line 32, the front wall 24 is connected to the second side wall 26 at a second vertical fold line 34, the second side wall 26 is connected to the rear wall 28 at a third vertical fold line 36, and the rear wall 28 is connected to the first side wall panel 22*b* at a fourth vertical fold line 38.

Major top flaps 40, 42 are joined to upper edges of the front wall 24 and rear wall 28, respectively, along an upper lateral fold line 44. The major flap 40 includes first and second flap sections 40*a*, 40*b* joined at an intermediate lateral fold line 46, and the major flap 42 includes first and second flap sections 42*a*, 42*b* joined at an intermediate lateral fold line 48.

Minor top flaps 50, 52 are joined to upper edges of the second side wall 26 and first side wall panel 22*b*, respectively, along the lateral fold line 44. The minor flap 50 comprises first and second flap sections 50*a*, 50*b* separated by a longitudinal slit 49, and the minor tab 52 comprises first and second flap sections 52*a*, 52*b* separated by a longitudinal slit 51.

A plurality of slits 53 may be formed in the lower ends of the front wall 24 and the rear wall 28 at the first longitudinal end 19 to cooperate with structure (not shown) in the base member 12*b* for securing the central tube 12*a* and base member 12*b* together in an assembled configuration. As noted above, the particular configuration of the base portion 12 can vary, and the connection structure of the lower portion of the central tube 12*a*, as currently illustrated by the slits 53, may be altered from the configuration shown to accommodate variations in the configuration of the base member 12*b*.

In a process for constructing the central tube 12*a* from the tube blank 16, the portion of the tube blank 16 between the second vertical fold line 34 and the first lateral edge 18, i.e., the first side wall glue tab 22*b* and the front wall 24, may be folded about the second vertical fold line 34 to overlap the first side wall glue tab 22*a* and the front wall 24 across the second side wall 26 and the rear wall 28. The first side wall panel 22*b* can be folded about the fourth vertical fold line 38 to position the first side wall panel 22*b* into overlapping engagement on the first side wall glue tab 22*a*, such that the second lateral edge 20 is located adjacent to the first vertical fold line 32. It may be understood that an adhesive, e.g., glue, may be applied to either the first side wall glue tab 22*a* or the first side wall panel 22*b* to adhere these panels together. The adhered first side wall glue tab 22*a* and first side wall panel 22*b* define a first side wall 22 of the central tube 12*a*, see FIG. 2.

Figure 4:
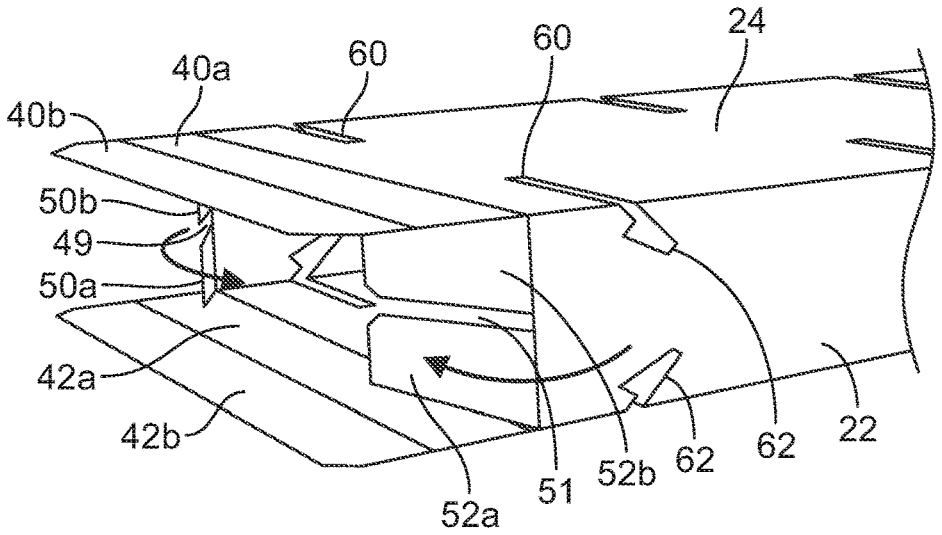
FIGS. 4 and 5 are perspective views of a top end portion of the central tube and illustrating an assembly operation including folding of major and minor flaps at the top end portion.
Figure 5:
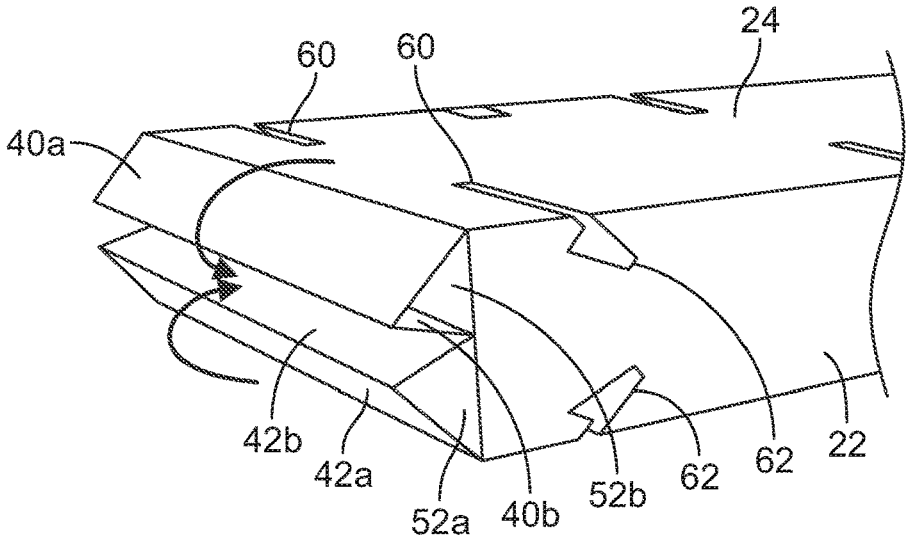

The central tube 12*a* may be erected from a flat configuration to the configuration shown in FIG. 4 by pivoting the first and second side walls 22, 26 about the front and back walls 24, 28 to form the central tube 12*a* as a rectangular tube. The minor flaps 50, 52 then can be folded inward. Subsequently, the major flaps 40, 42 can be folded inward by folding the second flap sections 40*b*, 42*b* about the respective fold lines 46, 48 and inserting the second flap sections 40*b*, 42*b* through the slits 49, 51 in the minor flaps 50, 52, see FIG. 5. The central tube 12*a* can then be assembled to the base member 12*b* to position the central tube 12*a* as a vertical column in preparation for mounting of the trays 14 to the central tube 12*a*.

Figure 6:
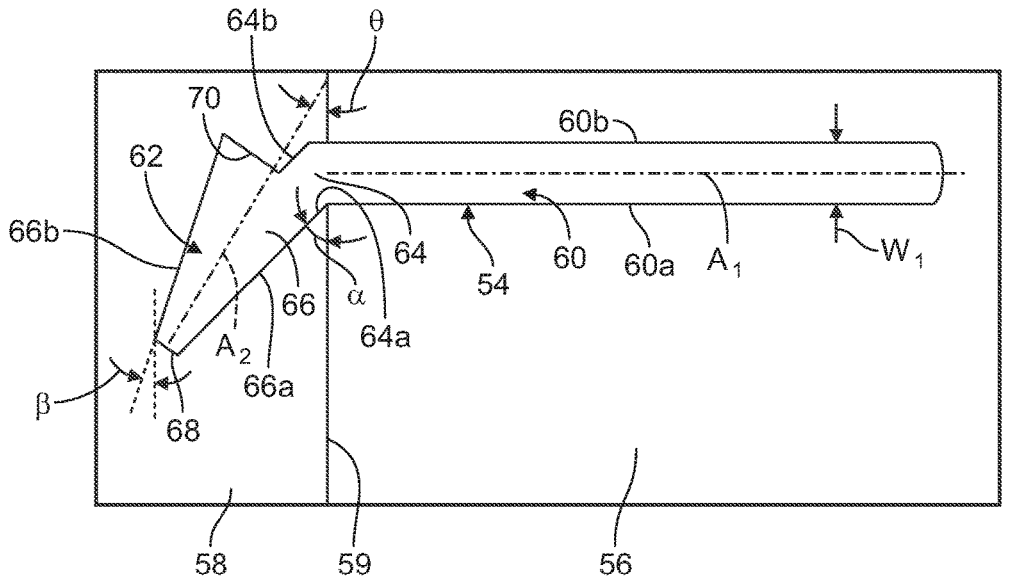
FIG. 6 is an enlarged view of a portion of the tube blank and illustrating a slot structure.

Referring to FIG. 3, the tube blank 16 includes slot structures 54 that define a first connection portion for mounting the trays 14 to the central tube 12*a*. Referring further to FIG. 6, a description of the details of the slot structures 54 is provided with reference to an enlarged view of one slot structure 54 extending between a first wall 56 and a second wall 58 separated by a fold line 59. The first wall 56 in FIG. 6 represents either the front wall 24 or the rear wall 28, the second wall 58 represents either the first side wall 22 or the second side wall 26 oriented transverse or perpendicular to the first wall 56 in the erected configuration of the central tube 12*a*, and the fold line 59 represents any of the vertical fold lines 32, 34, 36, or 38. The slot structure 54 includes a first slot portion 60 (front wall slot portion), and a second slot portion 62 (side wall slot), extending contiguous with the first slot portion 60. The first slot portion 60 defines a central axis $A_1$ that extends generally perpendicular to the fold line 59 and the second slot portion 62 defines a central axis $A_2$ that extends at a generally acute angle $\theta$ relative to the fold line 59.

The first slot portion 60 is formed between a pair generally parallel lower and upper edges 60*a*, 60*b* defining a first slot portion width $W_1$. The second slot portion 62 comprises an entry section 64 defined by first, entry section opposing edges 64*a*, 64*b*, and a latching section 66 defined by second, latching section opposing edges 66*a*, 66*b*. The entry section opposing edges 64*a*, 64*b* are each angled downwardly at an acute angle relative to the fold line 59, wherein the entry section opposing edges 64*a*, 64*b* may be angled downwardly at the same or about the same acute angle $\alpha$. The latching section opposing edges 66*a*, 66*b* diverge from a slot apex 68 distal from the first wall 56, and the latching section opposing edges 66*a*, 66*b* are each angled downwardly at an acute angle relative the fold line 59, wherein the latching section edge 66*a* may be a continuation of the entry section edge 64*a* and can be oriented at the acute angle $\alpha$. The latching section opposing edge 66*b* can be oriented at an acute angle $\beta$ relative to the fold line 59 different from the acute angle $\alpha$.

A detent edge 70 extends transverse to the edge 64*b* of the entry section 64, and can extend perpendicular to the entry section edge 64*b*. The detent edge 70 extends between and connects the entry section edge 64*b* and the adjacent latching section edge 66*b* to define an end of the latching section 66 adjacent to the entry section 64. Hence, the detent edge 70 defines or extends to a reduced slot width relative to the widest slot width defined between latching section edges 66*a*, 66*b* at an end adjacent to the front wall 24.

In the embodiment illustrated in FIG. 3, the slot structures 54 are located such that the first slot portions 60 are defined by discrete slots extending horizontally across a portion of either the front wall 24 or the back wall 28 adjacent to the vertical edges 32, 34 and 36, 38, wherein pairs of the first slot portions 60 are vertically aligned with each other on the front wall 24 and pairs of the first slot portions 60 are vertically aligned with each other on the back wall 28. In addition, the first side wall panel 22*b* may be formed with partial slot structures comprising second slot portions 62*a* that are configured the same as the second slot portions 62, as described above. The second slot portions 62*a* are aligned with the second slot portions 62 formed in the first side wall glue tab 22*a* when the first side wall panel 22*b* and the first side wall glue tab 22*a* are adhered together during formation of the central tube 12*a* from the tube blank 16.

Figure 7:
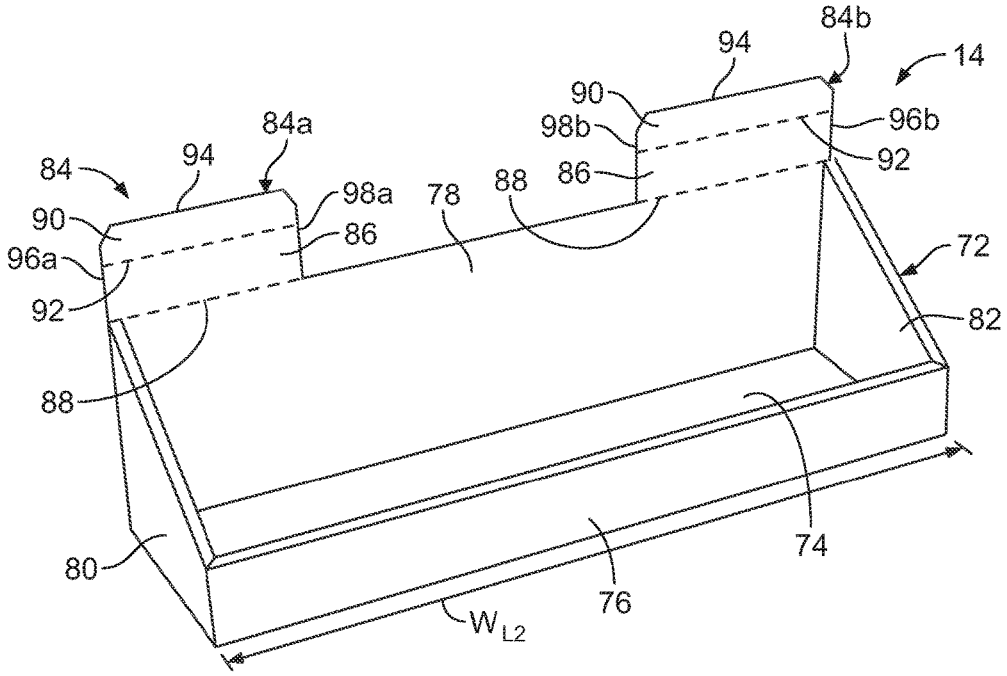
FIG. 7 is a perspective view of a tray having a mounting flap portion for use in forming a connection with the slot structure illustrated in FIGS. 3 and 6.

Referring to FIG. 7, an exemplary tray 14 illustrates a second connection portion for mounting the tray 14 to the central tube 12*a*. The tray 14 can be formed of corrugated paperboard blank (not shown) that is folded to form a tray body 72 comprising a tray bottom 74, a front wall 76, a back wall 78, a first side wall 80, and a second side wall 82. However, it should be understood that the invention is not limited to the particular configuration of the tray 14 described herein. The tray 14 further includes the second connection portion comprising a mounting flap portion 84 connected to the back wall 78. The mounting flap portion 84 is defined by a first mounting flap 84*a* and a second mounting flap 84*b*, each of which can be formed of corrugated paperboard material integral with the back wall 78.

Figure 8:
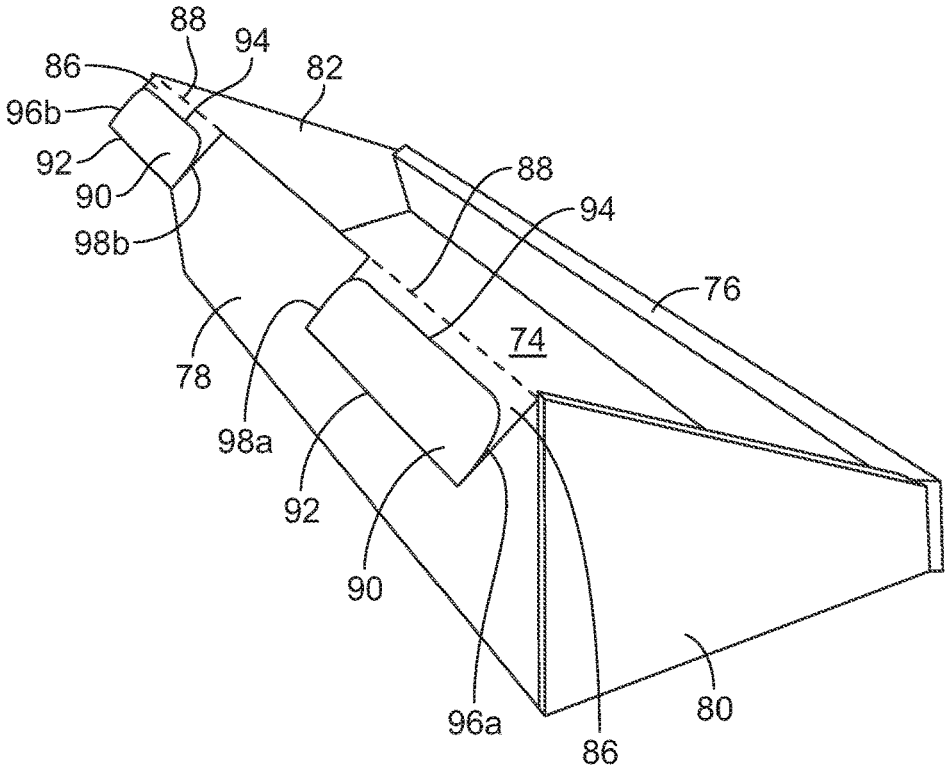
FIG. 8 is a perspective view of the tray of FIG. 7 showing the mounting flap portion folded at a flap fold.

Each mounting flap 84*a*, 84*b* includes a first flap section 86 hingedly connected to the back wall 78 at a fold line 88, and a second flap section 90 connected to the first flap section 86 at a flap fold 92. Referring further to FIG. 8, the first flap section 86 can be pivoted back toward a back side of the back wall 78 in preparation for mounting the tray 14 to the central tube 12*a*, and the second flap section 90 can be folded forward into overlapping relation over the first flap section 86.

Figure 9:
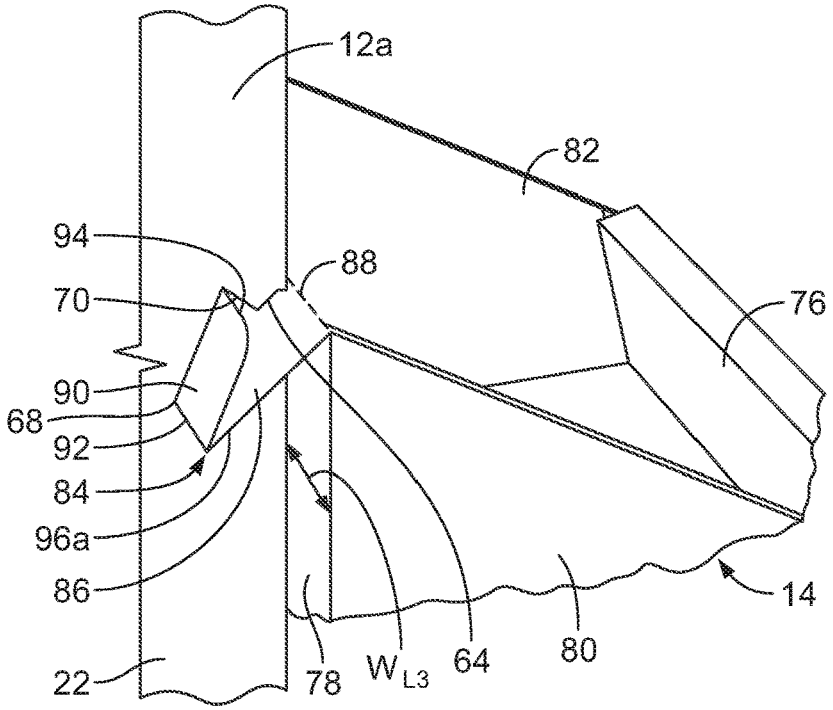
FIG. 9 is a perspective view illustrating the mounting flap portion engaged in the slot structure.

The process of mounting the tray 14 includes inserting the first and second mounting flaps 84*a*, 84*b* into respective slot structures 54 on opposing lateral sides of the front wall 24 or opposing lateral sides of the central tube 12*a* rear wall 28. Referring to FIGS. 6 and 9, the flap mounting portion 84 is inserted flap fold first through the first slot portions 60 into the second slot portions 62. The mounting flap portion 84 is inserted at a downward angle generally corresponding to the angle $\theta$ of the second slot portion 62 to position the first flap section 86 extending from the first wall, defined by either the front wall 24 or rear wall 28, through the first slot portion 60 and second slot portion 62 to the slot apex 68, such that the fold line 92 is located adjacent to the slot apex 68. During insertion of the mounting flap portion 84, the second flap section 90 is initially pressed toward engagement with the first flap section 86 as the mounting flap portion 84 passes through and engages the first portion edges 64*a*, 64*b* and the entry section edges 64*a*, 64*b* of the second slot portion 62. Subsequently, as a locking edge 94 of the second flap section 90, distal from the flap fold 92, is inserted past the detent edge 70, the second flap section 90 is resiliently biased within the latching section 66 toward engagement with the latching section edge 66*b*. The resiliently biased movement of the second flap section 90 is provided by the relatively stiff material characteristic of the corrugated paperboard forming the tray 14. As the second flap section 90 moves away from the first flap section 86, the locking edge 94 moves into an engagement position with the detent edge 70 to resist movement of the mounting flap portion 84 out of the slot structure 54. In the engagement position of the mounting flap portion 84, the first flap section 86 extends adjacent and generally parallel to the entry section edge 64*a* and the latching section edge 66*a*, and the second flap section 90 extends adjacent and generally parallel to the latching section edge 66*b* to locate the locking edge 94 in a locked position adjacent to the intersection of the detent edge 70 and the latching section edge 66*b*.

a. The engagement of the mounting flap portion 84 in the locked position within the slot structure 54 locates a portion of the first flap section 86 that is adjacent to the fold line 88 into a position engaged with the lower edge 60*a* of the first slot portion 60. Hence, the weight of the tray 14, which may be pre-loaded with product, can be supported by the central tube 12*a* at or adjacent to the fold line 88 on the tray 14. The locking engagement of the flap mounting portion 84, oriented at the downward acute angle, can facilitate positive latching of the tray 14 into the base portion 12. In particular, any force applied against the first flap section 86, such as by the weight of the tray 14, i.e., by a downward weight of the tray 14 tending to pivot the first flap section 86 upward about the lower edge 60*a*, can act to bias the locking edge 94 toward engagement with the detent edge 70 for retaining the mounting flap portion 84 within the slot structure 54. Further, it may be noted that the detent edge 70 extends upward from the entry section edge 64*b* to the latching section edge 66*b*, see FIG. 6, such that an apex formed between the latching section edge 66*b* and the detent edge 70 can engage and retain the locking edge 94.

As seen in FIGS. 1 and 7, a lateral width $W_{L2}$ of the tray 14 is wider than a lateral width $W_{L1}$ of the central tube 12*a*, wherein the lateral locations of outer edges 96*a*, 96*b* of the first and second mounting flaps 84*a*, 84*b* can coincide with the lateral locations of the first and second side walls 80, 82 of the tray body 72. As seen in FIG. 9, a laterally outer end of the tray 14 can extend laterally from a respective side, e.g., side 22, a predetermined lateral width distance $W_{L3}$. Hence, the mounting flap portion 84 defines a lateral width that positions the first and second flap sections 86, 90 extending laterally a sufficient distance for engagement with the first and second slot portions 60, 62, and that positions the locking edge 94 extending laterally across and adjacent to the detent edge 70. In addition, the first and second mounting flaps 84*a*, 84*b* can include respective inner edges 98*a*, 98*b*, see FIG. 7, that are located at or close to a lateral location of first slot portion ends 100*a*, 100*b*, see FIG. 3, to laterally position the tray 14, i.e., center the tray 14, relative to the central tube 12*a*.

It may be noted that although the description above describes mounting the trays 14 to the base portion 12 with particular reference to positioning the trays on the front wall 24 of the central tube 12*a*, the central tube 12*a* is provided with slot structures 54 for mounting trays 14 on the rear wall 28 in the same manner as is described above with reference to the front wall 24.

Figure 10:
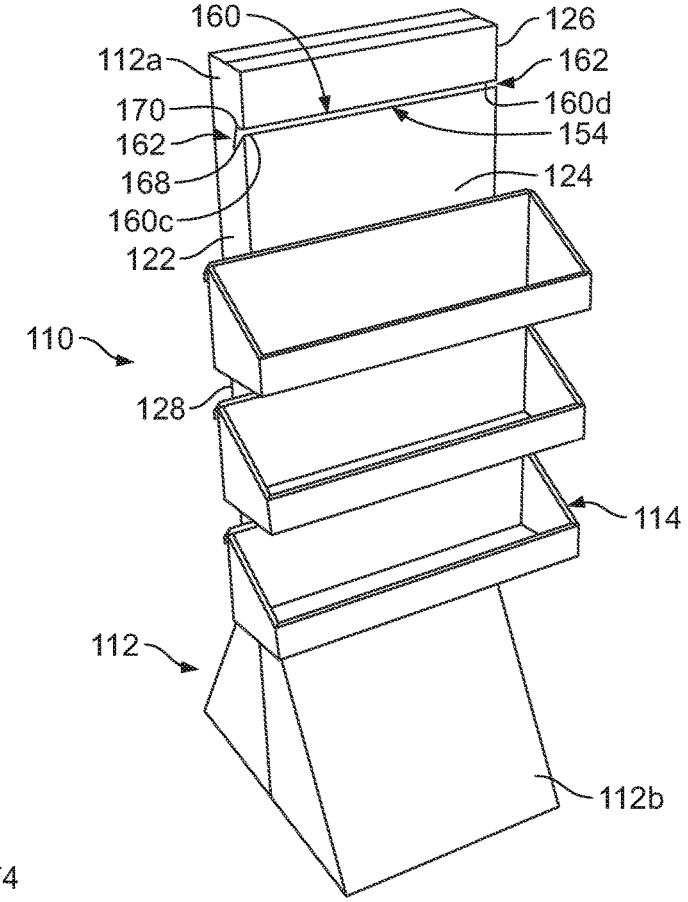
FIG. 10 is a perspective view of an alternative configuration of the floor display system and illustrating a slot structure having a continuous slot across a front wall of a central tube.
Figure 11:
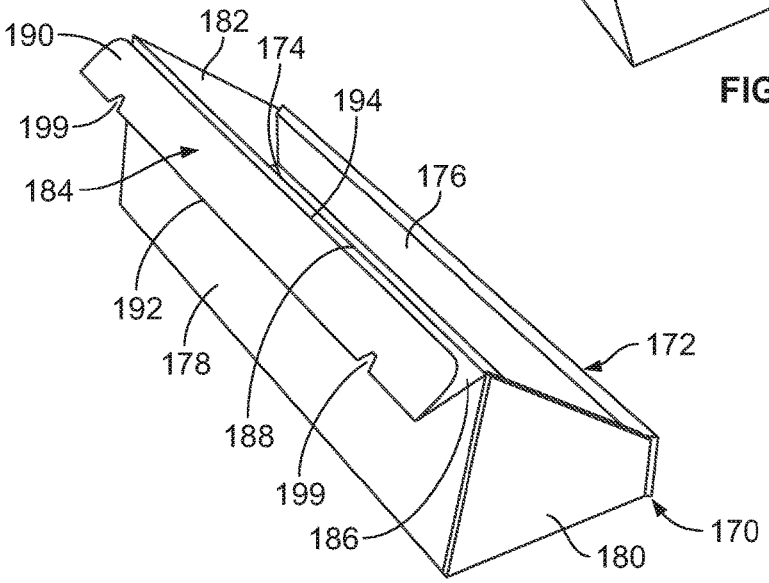
FIG. 11 is a perspective view of a tray illustrating a mounting flap portion configured to engage the slot structure of FIG. 10.

Referring to FIGS. 10 and 11, an alternative configuration of a floor display system 110 is illustrated in which elements corresponding to elements described with reference to FIGS. 1-9 are labeled with the same reference numerals increased by 100.

As seen in FIG. 10, the floor display system 110 includes a base portion 112 and a plurality of product trays 114 supported to the base portion 112. The base portion 112 can include a central tube 112*a* and a floor engaging base member 112*b*. The central tube 112*a* and base member 112*b* can be formed as separate components that are assembled together at a point of sale to support the central tube 112*a* in a vertical orientation.

The central tube 112*a* can be formed from a tube blank (not shown) in a manner similar to that described above with reference to forming the central tube 12*a* from the tube blank 16. In the present configuration, a first connection portion of a connection structure is defined by a plurality of slot structures 154 that are vertically spaced along the central tube 112*a*. The slot structures 154 are each formed with a first slot portion 160 extending horizontally across a front wall 124 of the central tube 112*a*, and including second slot portions or side wall slots 162 formed in side walls 122, 126 of the central tube 112*a*. The side wall slots 162 are contiguous with front wall slot portions 160*c*, 160*d* defined as end portions of the first slot portion 160 located adjacent to the side walls 122, 126. The side wall slots 162 are configured the same as is described for the second slot portions 62 with reference to FIG. 6. Further, the slot structures 154 can be formed the same as is described for the slot structures 54 above, except that the first portion 160 extends continuously across the front wall 124 rather than being formed with discrete or separate first slot portions 60 as described above for the central tube 12*a*.

Referring to FIG. 11, the tray 114 can be formed of a corrugated paperboard blank (not shown) that is folded to form a tray body 172 comprising a tray bottom 174, a front wall 176, a back wall 178, a first side wall 180, and a second side wall 182. However, it should be understood that the invention is not limited to the particular configuration of the tray 114 described herein. The tray 114 further includes a second connection portion of the connection structure comprising a mounting flap portion 184 connected to the back wall 178. The mounting flap portion 184 can be formed of corrugated paperboard material integral with the back wall 178.

The mounting flap portion 184 includes a first flap section 186 hingedly connected to the back wall 178 at a fold line 188, and a second flap section 190 connected to the first flap section 186 at a flap fold 192. The first and second flap sections 186 and 190 can be folded and inserted into the slot portion 154 to mount the tray 114 to the central tube 112*a* in a manner similar to that described above for mounting the tray 14 to the central tube 12*a*, wherein the second flap section 190 includes a locking edge 194 for engaging against a detent edge 170 in the side wall slots 162.

The lateral width of the tray 114 is greater than the lateral width of the central tube 112*a* and the mounting flap portion 184 can be provided with a pair of spaced locating notches 199 formed at the flap fold 192. The locating notches 199 can be spaced a dimension equal to the spacing between the side walls 122, 126 of the central tube 112*a*, such that each notch 199 engages against a respective slot apex 168 to laterally locate the tray 114, i.e., center the tray 114, relative to the central tube 112*a*.

It may be noted that the central body 112*a* of the display system 110 is provided with slot structures 154 having first slot portions 160 that only extend along the front wall 124, and the rear wall 128 of the central tube 112*a* can be formed without slot structures 154. By forming the rear wall 128 without slot structures 154, additional strength can be provided to the central tube 112*a* for resisting distortion of the central tube 112*a*.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A foldable display system comprising:

a first corrugated paperboard member including:

a first wall and a second wall extending transverse to the first wall at a fold line; a slot structure comprising a first horizontal slot portion in the first wall and a second slot portion in the second wall and extending diagonally downward from the first slot portion, wherein the second slot portion is continuous with the first slot portion;

the second slot portion including an entry section defined by first opposing edges and a latching section defined by second opposing edges diverging outwardly from a slot apex to a dimension greater than a dimension defined between the first opposing edges;

a second corrugated paperboard member including:

a mounting flap portion including a first flap section and a second flap section joined to and resiliently biased from the first flap section at a flap fold; and wherein the second flap section extends within the latching section of the second slot portion and includes a locking edge located adjacent to the entry section of the second slot portion and a mounting flap apex is defined by the flap fold, wherein the mounting flap apex and abuts the slot apex in order to removably suspend the second corrugated paper member from the first corrugated paperboard member.

2. The foldable display system as set forth in claim 1, wherein a detent edge of the slot structure extends transverse to and connects one of the first opposing edges of the entry section and to one of the second opposing edges of the latching section, and the locking edge of the second flap section engages the detent edge.

3. The foldable display system as set forth in claim 1, wherein the first flap section extends from the first slot portion to the slot apex within the second slot portion.

4. The foldable display system as set forth in claim 1, wherein the first slot portion extends on the first wall generally perpendicular to the fold line connecting the first and second walls, and at least one of the first opposing edges of the second slot portion extends at an acute angle relative to the fold line.

5. The foldable display system as set forth in claim 1, wherein each of the first opposing edges of the the entry section and each of the second opposing edges of the latching section extend at an acute angle relative to the fold line.

* * * * *